US007874767B2

(12) United States Patent
Jones et al.

(10) Patent No.: US 7,874,767 B2
(45) Date of Patent: Jan. 25, 2011

(54) WOVEN GEOSYNTHETIC FABRIC WITH DIFFERENTIAL WICKING CAPABILITY

(75) Inventors: David M. Jones, Dacula, GA (US); Wilson Harvie, Statham, GA (US); Kevin King, Alto, GA (US); Brett Albert Johns, Athens, GA (US)

(73) Assignee: Nicolon Corporation, Pendergrass, GA (US)

( * ) Notice: Subject to any disclaimer, the term of this patent is extended or adjusted under 35 U.S.C. 154(b) by 118 days.

(21) Appl. No.: 12/359,876

(22) Filed: Jan. 26, 2009
(Under 37 CFR 1.47)

(65) Prior Publication Data

US 2009/0245936 A1 Oct. 1, 2009

Related U.S. Application Data

(60) Provisional application No. 61/023,295, filed on Jan. 24, 2008.

(51) Int. Cl.
*E02B 11/00* (2006.01)
*E01F 5/00* (2006.01)

(52) U.S. Cl. ..... 405/302.7; 405/50

(58) Field of Classification Search ..... 405/36, 405/38, 39, 43, 44, 45, 50, 52, 302.7
See application file for complete search history.

(56) References Cited

U.S. PATENT DOCUMENTS

| | | | | | |
|---|---|---|---|---|---|
| 11,979 | A | | 11/1854 | Bunschoten | |
| 1,969,267 | A | * | 8/1934 | Hubbard | 404/27 |
| 2,183,253 | A | * | 12/1939 | Chambers | 404/31 |
| 3,765,783 | A | * | 10/1973 | Wager | 404/2 |
| 4,749,306 | A | | 6/1988 | Demeny et al. | |
| 5,200,248 | A | | 4/1993 | Thompson et al. | |
| 5,268,229 | A | | 12/1993 | Phillips et al. | |
| 5,611,981 | A | | 3/1997 | Phillips et al. | |
| 5,723,159 | A | * | 3/1998 | Phillips et al. | 425/461 |
| 5,733,490 | A | * | 3/1998 | Phillips et al. | 264/130 |
| 5,855,798 | A | * | 1/1999 | Phillips et al. | 210/767 |
| 5,972,505 | A | * | 10/1999 | Phillips et al. | 428/397 |
| 5,977,429 | A | | 11/1999 | Phillips et al. | |
| 5,980,155 | A | * | 11/1999 | Jones et al. | 405/43 |
| 6,103,376 | A | | 8/2000 | Phillips et al. | |
| 6,152,653 | A | | 11/2000 | Henry et al. | |
| 6,342,299 | B1 | | 1/2002 | Phillips et al. | |
| 6,352,664 | B1 | | 3/2002 | Phillips et al. | |
| 6,387,493 | B1 | | 5/2002 | Phillips et al. | |
| 6,403,217 | B1 | | 6/2002 | Phillips et al. | |
| 6,426,140 | B1 | | 7/2002 | Phillips et al. | |
| 6,436,518 | B1 | | 8/2002 | Phillips et al. | |
| 6,451,428 | B1 | | 9/2002 | Phillips et al. | |
| 6,465,096 | B1 | | 10/2002 | Phillips et al. | |
| 6,468,653 | B1 | | 10/2002 | Phillips et al. | |
| 6,492,023 | B1 | | 12/2002 | Phillips et al. | |
| 6,495,256 | B1 | | 12/2002 | Phillips et al. | |
| 6,497,955 | B1 | | 12/2002 | Phillips et al. | |
| 6,505,996 | B1 | * | 1/2003 | Ianniello et al. | 405/36 |
| 6,509,093 | B1 | | 1/2003 | Phillips et al. | |
| 6,610,402 | B2 | | 8/2003 | Phillips et al. | |

(Continued)

*Primary Examiner*—Frederick L Lagman
(74) *Attorney, Agent, or Firm*—Cantor Colburn LLP

(57) ABSTRACT

The present invention is directed to a geosynthetic wicking fabric for transporting water from beneath pavement structures to reduce or prevent damaged caused by frost heave and thaw. Further, the present invention is directed to a wicking drainage system employing the wicking fabric.

5 Claims, 6 Drawing Sheets

U.S. PATENT DOCUMENTS

| | | | | |
|---|---|---|---|---|
| 6,617,025 | B1 | 9/2003 | Phillips et al. | |
| 6,761,957 | B1 | 7/2004 | Phillips et al. | |
| 6,766,817 | B2 | 7/2004 | da Silva | |
| 6,918,404 | B2 | 7/2005 | Dias da Silva | |
| 7,066,586 | B2 | 6/2006 | da Silva | |
| 7,244,398 | B2 | 7/2007 | Kotary et al. | |
| 7,285,255 | B2 | 10/2007 | Kadlec et al. | |
| 7,341,400 | B2 | 3/2008 | Murfin | |
| 2002/0044842 | A1 * | 4/2002 | Ianniello et al. | 405/302.7 |
| 2003/0178194 | A1 * | 9/2003 | Andrews | 405/50 |
| 2007/0031192 | A1 | 2/2007 | Murfin | |
| 2007/0098500 | A1 * | 5/2007 | Harr | 405/43 |
| 2007/0292314 | A1 | 12/2007 | Effenhauser et al. | |
| 2008/0015531 | A1 | 1/2008 | Hird et al. | |

* cited by examiner

PRIOR ART

WOVEN GEOSYNTHETIC FABRIC WITH DIFFERENTIAL WICKING CAPABILITY

CROSS-REFERENCE TO RELATED APPLICATION

This application claims benefit of U.S. Provisional Patent Application Ser. No. 61/023,295 filed Jan. 24, 2008, which is incorporated herein by reference in its entirety.

TECHNICAL FIELD OF THE INVENTION

The present invention is related generally to woven fabrics. More specifically, the present invention is related to geosynthetic wicking fabrics and pavement structures employing same.

BACKGROUND OF THE INVENTION

Frost heave and thaw weakening can cause damage to pavement structures, such as parking areas, roadways, airfields, etc., in northern regions. The formation of ice lenses in the pavement structure is a significant contributor to such damage, as illustrated in FIG. 1. Three elements are necessary for ice lenses, and thus frost heave, to form. These are: (1) frost susceptible soil, (2) subfreezing temperatures, and (3) water. Often, water is available from the groundwater table, infiltration, an aquifer, or held within the voids of fine-grained soil. By removing any of the three elements above, frost heave and thaw weakening can be at least minimized or eliminated altogether.

Techniques have been developed to mitigate the damage to pavement structures caused by frost heave and thaw weakening. One such method involves removing the frost susceptible soils and replacing them with non-frost susceptible soils. The non-frost susceptible soil is placed at an adequate thickness to reduce the strain in the frost-susceptible soil layers below to an acceptable level. Other methods include use of insulation to reduce the freeze and thaw depth. In areas where removal of frost susceptible soils and reduction of subfreezing temperature are difficult and expensive, removal of water can lead to savings in construction costs by reducing the formation of ice lenses. By breaking the capillary flow path, frost action can be less severe.

A capillary barrier is a layer of coarse-grained soils or geosynthetic in a fine grained soil that (i) reduces upward capillary flow of soil water due to suction gradient generated by evaporation or freezing, and (or) (ii) reduces or prevents water from infiltrating from the overlying fine-pored unsaturated soil into the soil below the capillary barrier. In the latter case, if the capillary barrier is sloped, the infiltrating water flows in the fine soil downwards along the interface with the capillary barrier. Geosynthetic drainage nets (geonets) have been found to serve as capillary barriers because of their large pore sizes. The performance of nonwoven geotextiles as a capillary barrier appears to be compromised by soil intrusion into their interiors, decreasing the pore size and increasing the affinity of the material to water. Further, as reported by Henry (1998), "The use of geosynthetics to mitigate frost heave in soils." Ph.D. dissertation, Civil Engineering Department, University of Washington, Seattle, hydrophobic geotextiles have been more effective in reducing frost heave than hydrophilic geotextiles.

The above mentioned capillary barriers attempt to cut off the capillary water flow by generating a horizontal layer with very low unsaturated permeability under suction. The whole structure is permeable for downward rainfall infiltration. This type of capillary barrier requires that the barrier thickness exceed the height of the capillary rise of water in them. In addition, it provides conditions suitable for water vapor flow because of their high porosity and comparatively low equilibrium degrees of saturation.

Thus, there remains a need for a woven geosynthetic fabric with differential wicking capability that reduces or eliminates frost heave in soils. Accordingly, it is to solving this and other needs that the present invention is directed.

SUMMARY OF THE INVENTION

The present invention is directed to a woven geotextile wicking fabric. The wicking fabric comprises a polymeric yarn disposed in one axis of the fabric and a plurality of wicking fibers disposed substantially parallel to one another and woven with the polymeric yarn in another axis of the fabric. The wicking fiber comprises a non-round or non-oval cross-section and has a surface factor of about 100 cc/g/hr to about 250 cc/g/hr. In one aspect of the present invention, the cross-sectional shape of the wicking fiber is multichannel, trilobal, or pillow.

In another aspect of the present invention, a wicking drainage system is disclosed. The wicking drainage system comprises a wicking fabric layer disposed on a layer of frost susceptible soil. A layer of non-frost susceptible soil is disposed on the wicking fabric. Optionally, a base layer for supporting asphalt and/or concrete is disposed on the non-frost susceptible soil. The wicking drainage system can further comprise an impermeable hydrophobic geomembrane disposed below the wicking fabric. Further, the wicking fabric can be tilted with respect to the water table and/or the asphalt and/or concrete layer being supported by the wicking drainage system.

Yet, in another aspect of the present invention, a wicking drainage system comprises a wicking fabric layer disposed on a first layer of frost susceptible soil. A second layer of frost susceptible soil is disposed on the wicking fabric layer. Disposed on the second layer of frost susceptible soil is a geotextile layer. A layer of non-frost susceptible soil is disposed on the geotextile layer. Optionally, a base layer for supporting asphalt or concrete is disposed on the non-frost susceptible soil. The geotextile layer can be another wicking fabric layer.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the accompanying drawings showing the embodiments and aspects of the present invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DETAILED DESCRIPTION OF THE INVENTION

Figure 1:
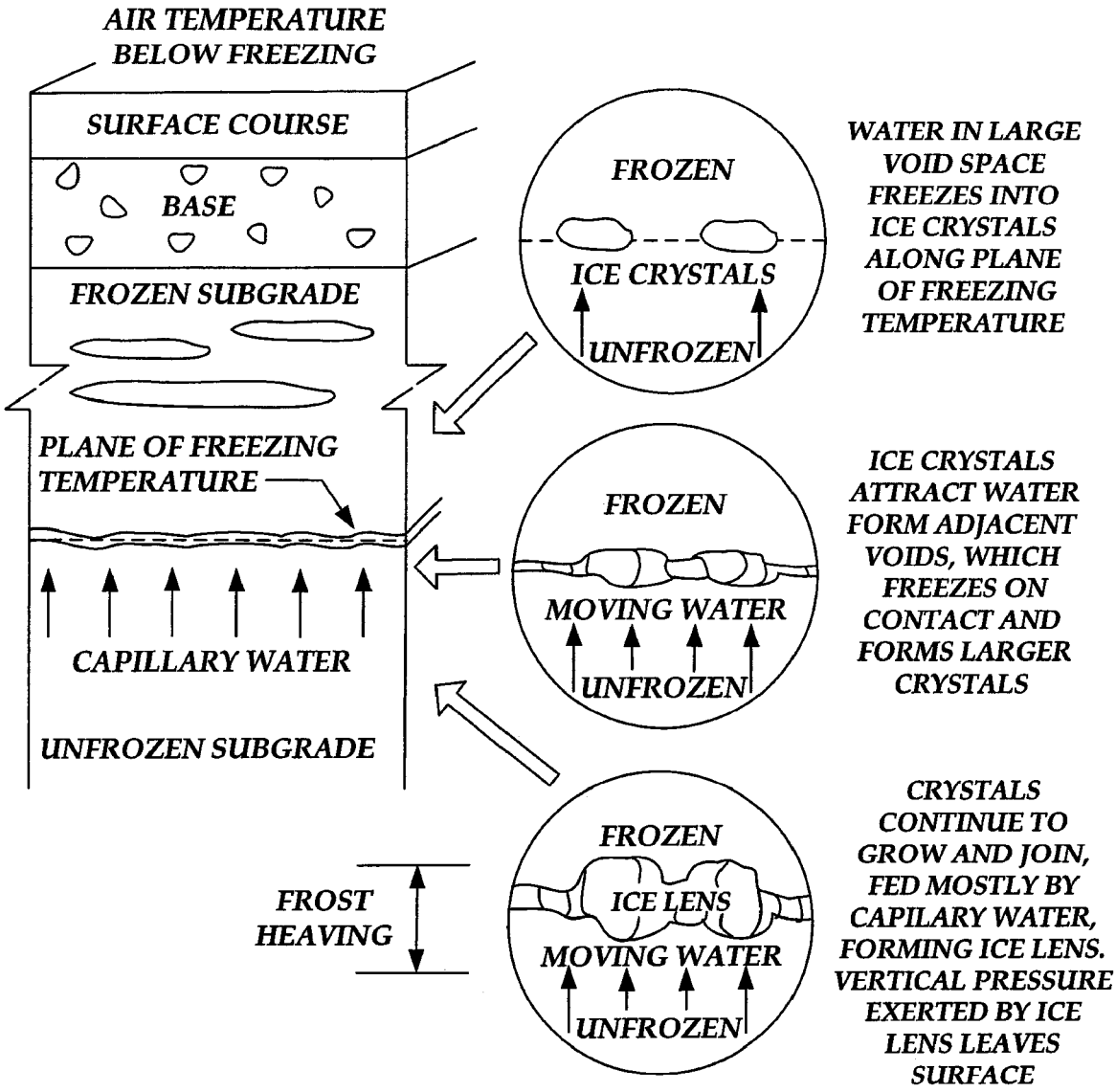
FIG. 1 is an illustration of the formation of ice lenses in a pavement structure.

The present invention is directed to a woven, wicking fabric that optimizes capillary tension substantially in a single axis to enhance dewatering around the fabric protected area versus conventional fabrics. For example U.S. Pat. No. 6,152,653, which is incorporated herein by reference in its entirety, describes a geocomposite capillary barrier drain (GCBD) for displacing water from beneath pavement. The GCBD system employs a transport layer, a capillary barrier and a separator layer. Specifically, the GCBD transport layer utilizes the capillary properties of a fiberglass fabric to displace water away from the paved surface. In accordance with the present invention, the novel woven fabric described below can be incorporated into the GCBD system by replacing the fiberglass fabric. Further, the novel woven fabric of the present invention can be employed to replace the GCBD system altogether.

In accordance with the present invention, a geotextile woven, wicking fabric comprises a conventional yarn or a filament in one axis and a wicking fiber woven with the yarn or filament in another axis to form the fabric. For example, the wicking fiber can be woven into the wicking fabric in either the warp or the weft directions. The wicking fiber has a non-round or non-oval cross-section with a surface factor between about 1.5 and about 3.3. In another aspect the wicking fiber has a flux range of about 100 cc/g/hr to about 250 cc/g/hr. Yet, in another aspect the wicking fiber maintains at least about 80% flux up to 60,000 ft-lb/ft$^3$. Still, in another aspect the wicking fiber maintains unsaturated hydraulic conductivity in environments having saturations between 100% and 17%. As indicated above the fabric of the present invention finds utility in civil engineering applications. The polymers described below can be employed to make the conventional yarn or filament.

Wicking Fibers

In one aspect of the present invention, wicking fibers are woven into a wicking fabric substantially parallel to one another. As a result, a fluid, such as water, is transported along the wicking fibers to the periphery of the woven fabric of the present invention. That is, the wicking fibers move the fluid substantially along a single axis. Wicking fibers employed in the present invention have a high surface factor of less than 1.5 as compared to a round cross -sectional fiber of the same denier having a high surface factor of 1.0. Such wicking fibers generate increased capillary action over round cross-sectional fibers of the same denier. Several types if fibers can be employed in the present invention and are described below.

U.S. Pat. No. 5,200,248, which is incorporated herein by reference in its entirety, describes capillary channel polymeric fibers that can be employed in the present invention. Such fibers store and transport liquid and have non-round, cross-section shapes which include relatively long thin portions. The cross-section shapes are substantially the same along the length of the fiber. Further, these capillary channel fibers can be coated with materials that provide an adhesion tension with water of at least 25 dynes/cm.

U.S. Pat. No. 5,268,229, which is incorporated herein by reference in its entirety, describes fibers that can be employed in the present invention. These fibers have non-round cross-sectional shapes, specifically "u" and "E" shaped cross-sections with stabilizing legs. Further, these fibers are spontaneously wettable fibers and have cross-sections that are substantially the same along the length of the fiber.

U.S. Pat. No. 5,977,429, which is incorporated herein by reference in its entirety, describes fibers having distorted "H" shape, a distorted "Y" shape, a distorted "+" shape, a distorted "U" shape, and a distorted shape of a spun fiber that is referred to as "4DG". Such fibers can be employed in the present invention.

U.S. Pat. No. 6,103,376, which is incorporated herein by reference in its entirety, describes a bundle of synthetic fibers for transporting fluids which can be employed in the present invention. The bundle comprises at least two fibers that when acting as individual fibers are poor transporters of fluids, yet when in a bundle the fibers provide a bundle that is an effective transporter of fluids. As described, the bundle has a Specific Volume greater than 4.0 cubic centimeters per gram (cc/gm), an average inter-fiber capillary width of from 25 to 400 microns, and a length greater than one centimeter (cm). At least one of the two fibers has a non -round cross-section, a Single Fiber Bulk Factor greater than 4.0, a Specific Capillary Volume less than 2.0 cc/gm or a Specific Capillary Surface Area less than 2000 cc/gm, and more than 70% of intra-fiber channels having a capillary channel width greater than 300 microns.

Wicking fibers employed in the present invention are made from the major melt spinnable groups. These groups include polyesters, nylons, polyolefins, and cellulose esters. Fibers from poly(ethylene terephthalate) and polypropylene are useful in the present invention at least because of their manufacturability and wide range of applications. The denier of each fiber is between about 15 and about 250, or between about 30 and about 170.

In addition, wicking fibers can be formed from other polymers that shrink significantly when heated, such as polystyrene or foamed polystyrene. The step of shrinking introduces the distortion in the fiber that increases long-range distortion factor (LRDF) and short range distortion factor (SRDF). The relatively large values of LRDF and/or SRDF of the fibers described in U.S. Pat. No. 5,977,429 provide their utility in absorbent products. Shrinking occurs for oriented amorphous polymeric fibers when the fibers are heated above their glass transition temperature. The shrinking occurs either prior to or in the absence of substantial crystallization.

As indicated above, the wicking fibers of the present invention can be made of any polymeric material that is insoluble in the fluid which is to be contacted with the capillary channel structures. For example, the polymer utilized can be a thermoplastic polymer, which can be extruded and drawn via an extrusion process to form the final product. Examples of suitable polymeric materials, in addition to polyester, polystyrene and polyolefins such as polyethylene and polypropylene, include polyamides, chemical cellulose-based polymers such as viscose and di- or tri-ace-. Co-, ter-, etc. polymers and grafted polymers can also be used. One type of thermoplastic polymer can be employed in the present invention are polyesters and copolymers of dicarboxylic acids or esters thereof and glycols. The dicarboxylic acid and ester compounds used in the production of polyester copolymers are well known to those of ordinary skill in the art. They include terephthalic acid, isophthalic acid, p,p'-diphenyldicarboxylic acid, p,p'-dicarboxydiphenyl ethane, p,p'-dicarboxydiphenyl hexane, p,p'-dicarboxydiphenyl ether, p,p'-dicarboxyphenoxy ethane, and the like, and the dialkylesters thereof that contain from 1 to about 5 carbon atoms in the alkyl groups thereof.

Aliphatic glycols useful for the production of polyesters and copolyesters are the acrylic and alicyclic aliphatic glycols having from 2 to 10 carbon atoms, such as ethylene glycol, trimethylene glycol, tetramethylene glycol, pentamethylene glycol, and decamethylene glycol.

It is additionally contemplated to utilize copolymers or graft copolymers, terpolymers, chemically modified polymers, and the like, which permanently exhibit high surface hydrophilicity and do not require the use of wetting agents, which may wash away from the structure surface upon contact with fluids. Modified polymers which can exhibit permanent hydrophilicity include chemical cellulose polymers such as cellulose acetates. In addition, one can also include pigments, delusterants or optical brighteners by the known procedures and in the known amounts.

A type of polyester which can be employed in the present invention is glycol modified poly(ethylene terephthalnelate) (pETG) copolyester. Suitable PETG is available from Eastman Chemical Products, Inc. (Kingsport, Tenn., USA), under the name KODAR™ 6763, with a glass transition temperature of about 81° C.

Another factor affecting polymer choice is amenability to chemical modification of its surface for increasing, for example, hydrophilicity. Thus, for capillary channel structures intended for absorbing and/or transporting aqueous based solutions, it can be advantageous to use a polyester-based polymer rather than, for example, a polypropylene. However, this selection option is not meant to thereby limit the scope of the invention. Also, depending upon the intended use of the structures, it can be desirable that the polymer material utilized be flexible at the temperatures at which the structures are intended to be used. Due to the relatively thin walls and bases of the structures hereof, even relatively high modulus polymers can be used to make structures that are both flexible and soft, yet which retain surprisingly high resistance to collapse. Flexibility will depend upon such factors as the thickness and dimensions of the capillary channel walls and base, as well as the modulus of elasticity. Thus, choice of polymer in this regard will be highly subject to the intended use and temperature conditions. Choice of such suitable polymer material is well within the ability of one of ordinary skill in the art.

Depending upon the intended use, the capillary channel structures can be made from polymers that are either hydrophilic or oleophilic, or can be treated to be hydrophilic or oleophilic.

The surface hydrophilicity of polymers used to make the capillary channel structures of the present invention can be increased to make the capillary channel walls more wettable to water or aqueous solutions by treatment with surfactants or other hydrophilic compounds (hereafter, collectively referred to as "hydrophilizing agents") known to those skilled in the art. Hydrophilizing agents include wetting agents such as polyethylene glycol monolaurates (e.g., PEGOSPERSE™ 200 ML, a polyethylene glycol 200 monolaurate available from Lonza, Inc., Williamsport, Pa., USA), and ethoxylated oleyl alcohols (e.g., VOLPO™-3, available from Croda, Inc., New York, N.Y., USA). Other types of hydrophilizing agents and techniques can also be used, including those well known to those skilled in the fiber and textile arts for increasing wicking performance, improving soil release properties, etc. These include, for example, surface grafting of polyacrylic acid. Suitable commercially available hydrophilizing agents include ZELCON™ soil release agent, a nonionic hydrophile available from DuPont Co., Wilmington, Del. (USA) and Milease T™, comfort finish available from ICI Americas, Inc., Wilmington, Del., USA. In addition, ERGASURF, ceramic microbeads and vinyl pyrrolidone can be employed as hydrophilic or hygroscopic additives.

The capillary channel structures of the wicking fibers have an axial base and at least two walls extending from the base, whereby the base and walls define at least one capillary channel. Certain of such fibers have at least five walls and at least four capillary channels. Others can have at least six walls and at least five capillary channels. There is no theoretical maximum number of capillary channels that the structure hereof can have, such maximum number of capillary channels being governed more by need for such structures and practicability of making them. In one aspect of the present invention, the capillary channels are substantially parallel with one another and an open cross-section along at least about 20% of their length, along at least about 50% of their length or and along from at least 90% to 100% of their length.

Wicking fibers of the present invention provide flexible, collapse-resistant, capillary channel structures comprising a polymer composition and having at least one intrastructure capillary channel, wherein the structures have an axial base and at least two walls extending from the base, typically (but not necessarily) along substantially the entire length of the base element, whereby the base element and walls define said capillary channel(s). In general, the walls should extend from the base for a distance in the axial direction of the base for at least about 0.2 cm. In another aspect of the present invention, the walls extend from the base for a distance in the axial direction of the base for at least about 1.0 cm. The actual length of the structure is limited only by practical concerns. Although the capillary channel structures hereof can have one capillary channel or a plurality of capillary channels, for convenience the plural form "channels" is used with the intent that it shall refer to a singular "channel" in structures having only one such channel or a plurality of channels in structures having more than one channel. The structures are further characterized in that the capillary channels are open along a substantial length such that fluid can be received from outside of the channel as a result of such open construction. In general, the structures will typically have Specific Capillary Volume (SCV) of at least about 2.0 cc/g, at least about 2.5 cc/g or at least about 4.0 cc/g, and a Specific Capillary Surface Area (SCSA) of at least about 2000 $cm^2$ g, at least about 3000 $cm^2/g$ or at least about 4000 $cm^2/g$. The procedures to be used for measuring SCV and SCSA are provided in at least one of the patents incorporated above.

The wicking fibers of the present invention have a surface composition that is hydrophilic, which may be inherent due the nature of the material used to make the fibers or may be fabricated by application of surface finishes. Hydrophilic surface finishes provide structures the surfaces of which have large adhesion tension (i.e., that strongly attract) with aqueous liquids and are therefore preferred for applications involving aqueous liquids such as those discussed below for temporary acquisition/distribution structures and permanent storage structures. In one aspect, the hydrophilic surface has an adhesion tension with distilled water greater than 25 dynes/cm as measured on a flat surface having the same composition and finish as the surface of the fiber. Some of the finishes/lubricants useful to provide large adhesion tensions to aqueous liquids are described or referenced in U.S. Pat. No. 5,611,981, which is incorporated by reference herein in its entirety. Surface finishes are well known in the art.

As discussed above, the wicking fibers have channels on their surface which may be useful in distributing or storing liquids when the proper surface energetics exist on the surface of the fibers, such as when the fibers satisfy the above equation relating to specific surface forces. The surface energetics determine the adhesion tension between the surface and whatever liquid is in contact with the surface. The larger the adhesion tension, the stronger the force of attraction between the liquid and the surface. The adhesion tension is one factor in the capillary forces acting on the liquid in a channel. Another factor affecting the capillary forces acting on a liquid in a channel is the length of the perimeter of the channel. When the widths of the channels are small, the capillary forces are relatively strong compared to the force of gravity on the liquid, since the force of gravity on the liquid in a channel is proportional to the area of the channel.

Figure 2:
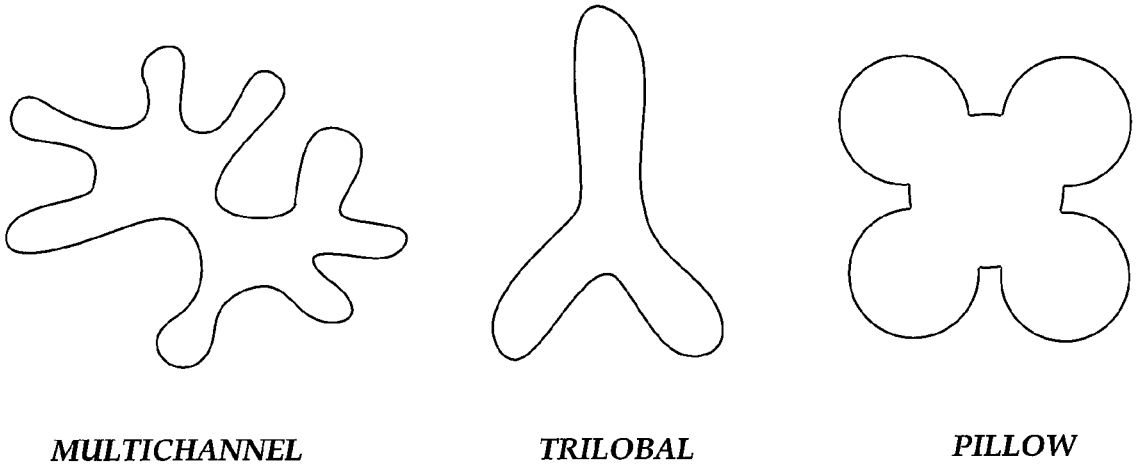
FIG. 2 is an illustration of wicking fiber cross-sections employed in the present invention.

FIG. 2 illustrates wicking fiber cross-sections of multichannel, trilobal, and pillow that can be employed in the present invention. However, as indicated in patent discussed above, other shapes can be employed in the present invention. The multichannel is also referred to as the "4DG" shape.

In one aspect of the present invention, a wicking fabric made from nylon has high wettability similar to fiberglass. The wicking fabric has a high specific surface area of 3650 $cm^2/g$ and high permeability of 0.55 cm/s (equivalent to a flow rate of 1385 $l/min/m^2$).

Weaves

Weaves which can be employed in the present invention include, but are not limited to, plain, twills, specialty weaves, 3-D's, satins, sateens, honeycombs, lenos, baskets, oxfords, or panamas. FIG. 2 is a photomicrograph of a geosynthetic fabric of the present invention.

Wicking Drainage System

Figure 3:
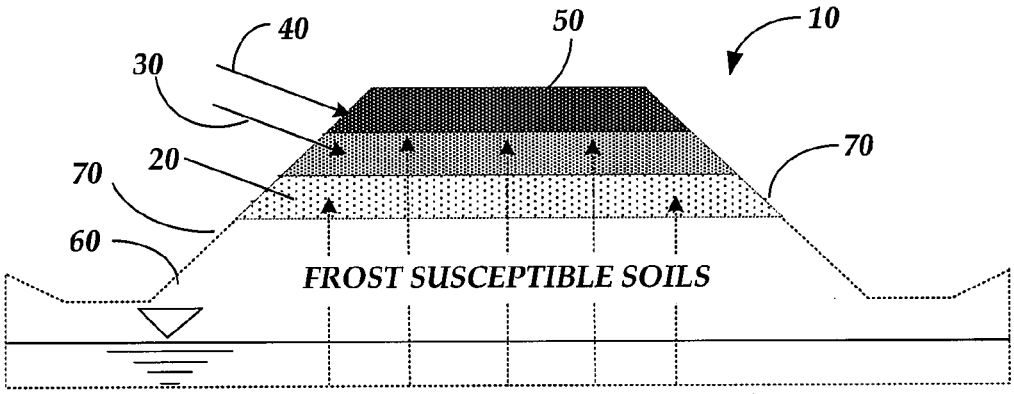
FIG. 3 is an illustration of a wicking drainage system in accordance with the present invention.

Referring to FIG. 3, in accordance with the present invention, a wicking drainage system 10 comprises a wicking fabric 20, a non-frost susceptible soil layer 30 disposed over the wicking fabric, and a base layer 40, such as an asphalt treated base, disposed on the soil layer 30. Asphalt and/or concrete 50 are disposed on the base layer 40. The wicking fabric 20 is disposed on frost susceptible soil bed 60. The frost susceptible soil bed 60 is raised above the water table to form side drains 70 which facilitate water drainage. The thickness of the frost susceptible soil bed 60 is conventional. For example, soil bed 60 can be 40 inches above the water table. Non-frost susceptible soil layer 30, such as the D1 material with 10% fines content described below, should be of a sufficient thickness as to allow water drainage from the base layer 40 to the wicking fabric 20. In one aspect of the present invention, the thickness of the non-frost susceptible soil layer 30 is about 13 inches. However, the thickness can be varied as necessary depending upon soil conditions.

In another aspect of the present invention, the wicking drainage system comprises an impermeable hydrophobic geomembrane (not shown) disposed below the wicking fabric 20. The wicking fabric 20 allows water from the overlying soil to pass through the wicking fabric 20 when the overlying soil is saturated and transport water laterally to side drains 70. When the overlying soil is unsaturated, the wicking fabric can absorb water from the overlying unsaturated soil and transport it in the lateral directions. The impermeable hydrophobic geomembrane can repel water and completely cut off the capillary rise of ground water from beneath. In another aspect of the present invention, the geomembrane can be a one-way-valve geotextile.

Figure 4:
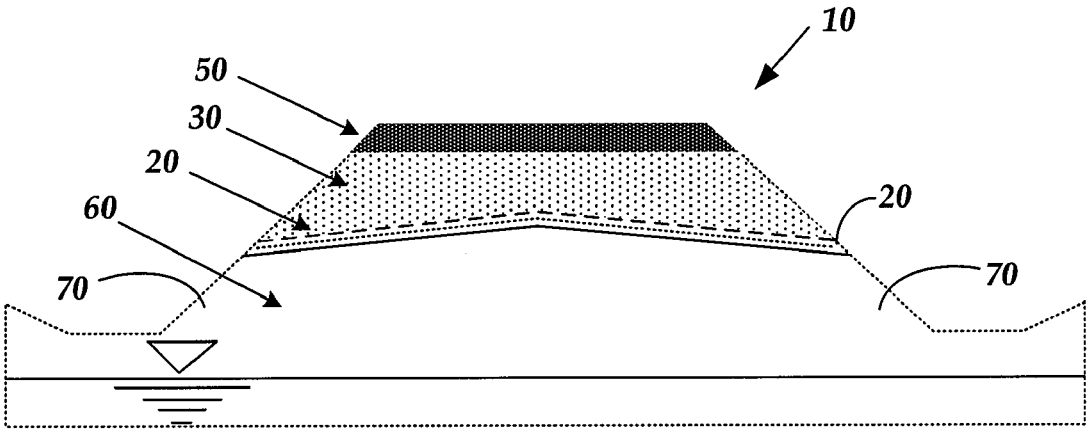
FIG. 4 is an illustration of another aspect of the wicking drainage system in accordance with the present invention.
Figure 5:
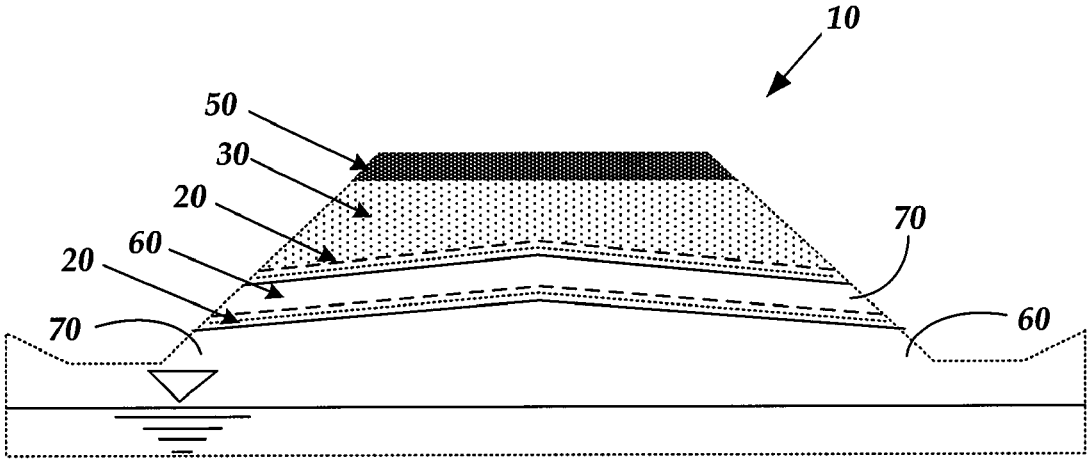
FIG. 5 is an illustration of yet another aspect of the wicking drainage system in accordance with the present invention.
Figure 6:
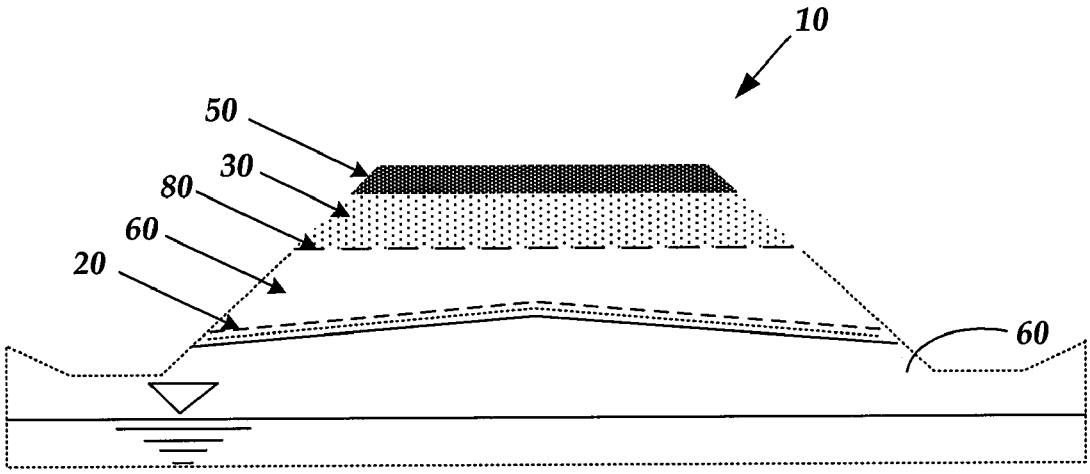
FIG. 6 is an illustration of still another aspect of the wicking drainage system in accordance with the present invention.

In an alternate design, the wicking drainage system comprises the arrangement as shown in FIGS. 4-6. When installed in the pavement structure, the wicking fabric 20 is tilted at a slope from 5-10% so that infiltrating water will flow downdip. Furthermore, there should not be wrinkles of any significance that would cause water to pond on top of impermeable layer. FIG. 4 illustrates the wicking drainage system 10 of FIG. 3 with the tilted arrangement.

As illustrated in FIG. 5, a second layer of wicking fabric 20 is employed in the wicking drainage system 10. Disposed between the respective layers of wicking fabrics 20 is a layer of frost susceptible soil. In another aspect of the present invention, as illustrated in FIG. 6, the wicking fabric 20 is disposed on a layer of frost susceptible soil 60. Further, another layer of frost susceptible soil 60 is disposed on the wicking fabric 20. A geotextile separation layer 80 is disposed on the second layer of frost susceptible soil 60, and a layer of non-frost susceptible soil 30 is disposed on the geotextile separation layer 80.

The overall effect of the wicking drainage system is to cut off upward capillary water flow and drain most of the infiltrated water out of the pavement structure through the tilted drainage net by the wicking fabric. The diving force for the water flow in the drainage net is gravity and the driving forces for the water flow in the wicking fabric are gravity and suction generated by evaporation and freezing.

EXAMPLES

Example 1

Sieve Analysis and Gradation Curves for Two Typical Soils in Alaska

Figure 7:
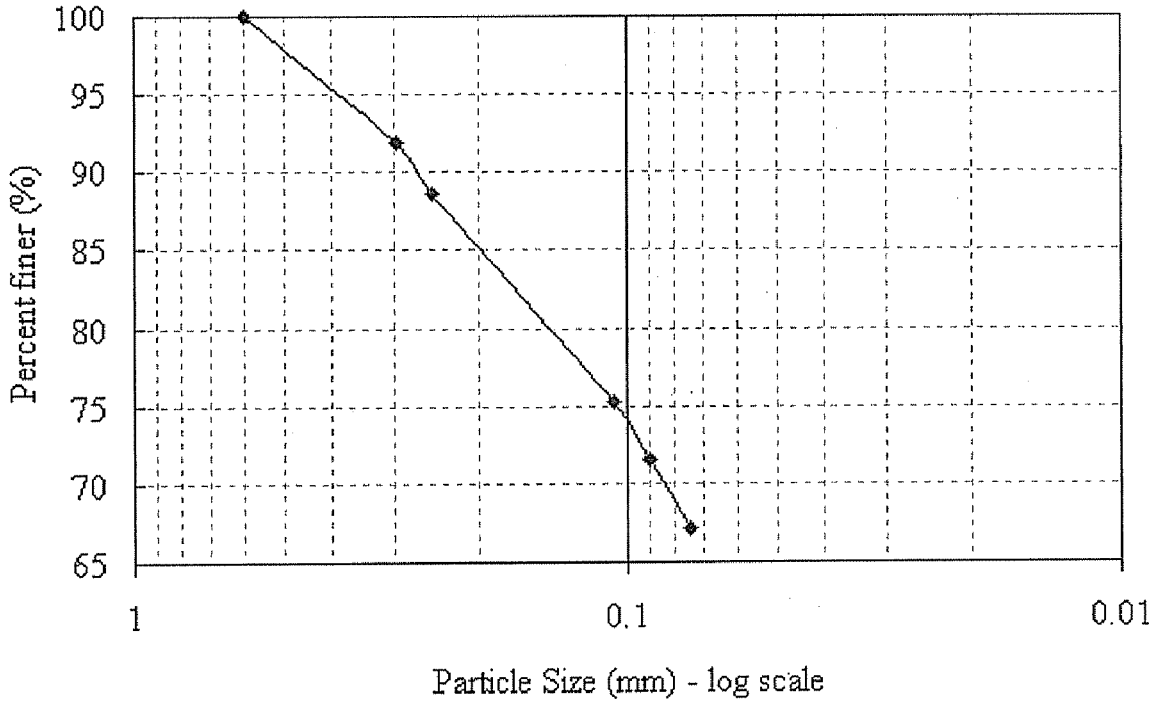
FIG. 7 is a graph illustrating sieve analysis of silt taken from the CREEL permafrost tunnel.

Two typical soils employed in Alaskan pavements were collected. These soils were Fairbanks silt obtained from the CREEL permafrost tunnel and D1 material obtained from University Ready Mix Company. Silt is a frost-susceptible soil and typically used as subgrade for Alaska pavements. The silt from the CREEL permafrost tunnel was sieved to remove organic material. A sieve analysis was performed on the silt and is shown in FIG. 7.

Figure 8:
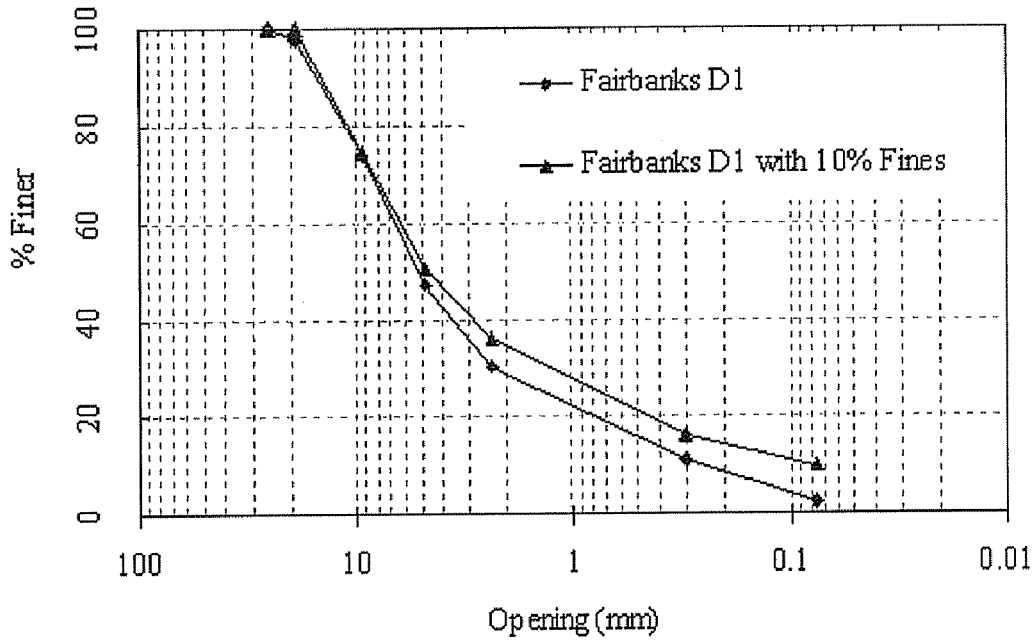
FIG. 8 is a graph illustrating sieve analysis of D1 material in Fairbanks.

The D1 material was a typical non-frost susceptible material which is typically employed as base courses in Alaska pavements. To be qualified as a D1 material, the fines content has to be less than 4%. In this example, sieve analysis was made for the Fairbanks D1 material and fines with grain size less than 0.075 mm was added to make a new frost susceptible material with 10% fines content. The gradation curves for the original and fabricated D1 materials are shown in FIG. 8.

Example 2

Modified Proctor Compaction Tests

Figure 9:
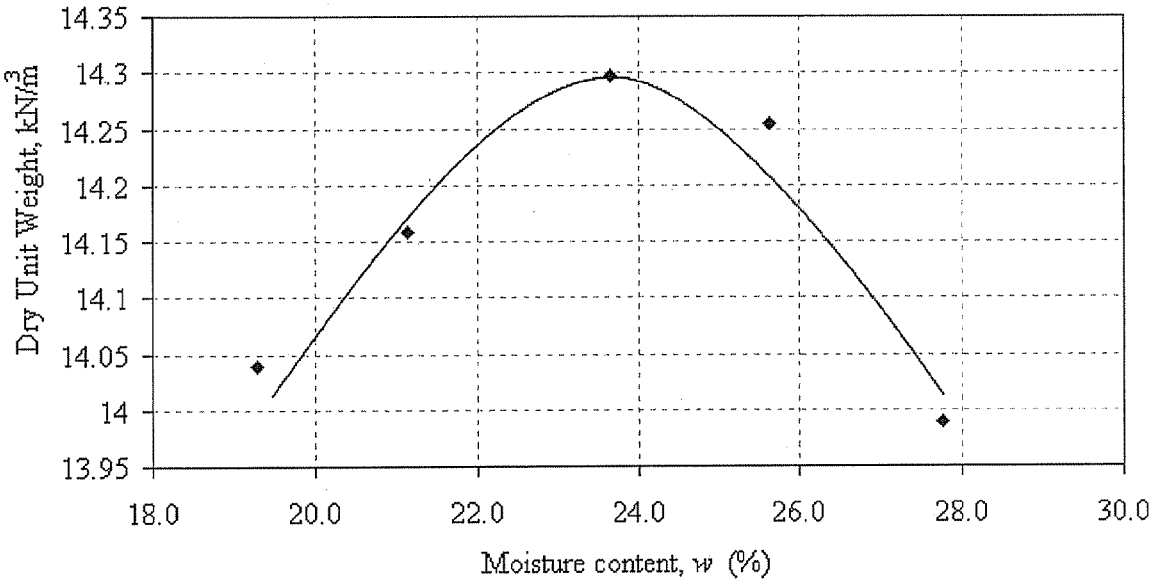
FIG. 9 is a graph illustrating compaction test results for silts from CREEL permafrost tunnel.
Figure 10:
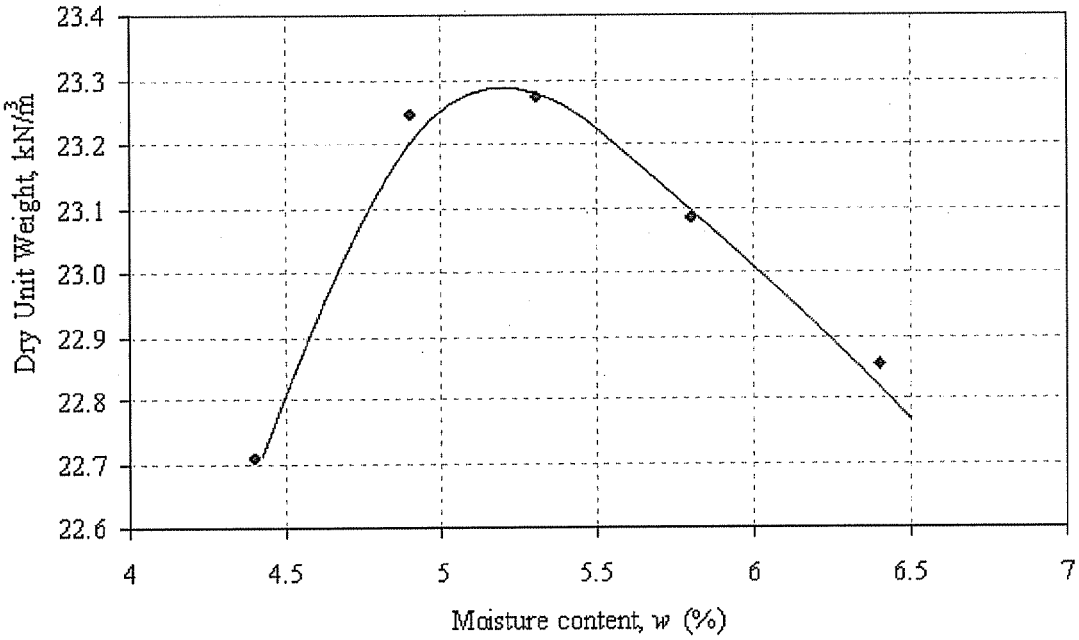
FIG. 10 is a graph illustrating compaction test results for Fairbanks D1 material with 10% fines.

The Fairbanks silt and the D1 material with 10% fines content were compacted in accordance with ASTM D1557 in order to simulate the compaction process in the field. The compaction test results are as shown in FIGS. 9 and 10.

Example 3

Soil Water Characteristic Curve

Figure 11:
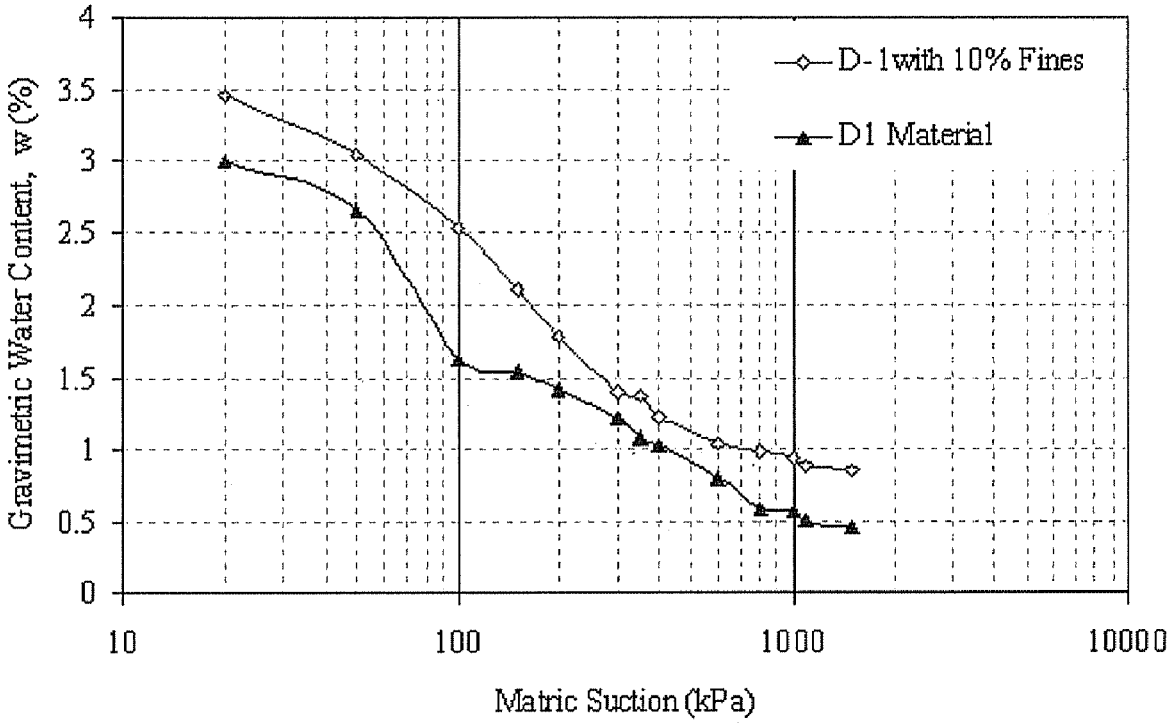
FIG. 11 is comparison of gravimetric water content to matric suction for Fairbanks D1 material.

Pressure plate tests in accordance with ASTM D2325-68 were used to obtain the water retention characteristic curve in the range from 0 to 1500 kPa. The salt concentration tests were used to measure the soil water characteristic curve for suction values are greater than 1,500 kPa. FIG. 11 shows the test results for Fairbanks D1 Material.

Example 4

Soil Column Tests

Using the D-1 material with 10% fines and at the optimum moisture content, cylinders were constructed. The cylinders were compacted in five layers, 52 blows to each layer. Geosynthetic materials were placed above the second layer. 13 different cylinders were made testing 5 different geosynthetic materials ((Nylon Wicking Fabric, Glass Fabric, HP570, FW402, and HIPS board). 5 cylinders were made with the geosynthetic material being the same size as the cylinder and 5 cylinders were made with the appropriate geosynthetic material protruding outwards in order to understand the effects and advantages of drainage capabilities for each geosynthetic material. A membrane was placed around each cylinder in order to retain the moisture within the cylinder. Baths were setup to allow for water infiltration from the bottom of the cylinder. The evaporation within the room that the water baths were put in was measured by filling a glass full of water and measuring the weight of the glass of water each day for one week. Water was added to the water baths throughout the week.

Example 5

Laboratory Capillary Rise Tests and Soil Water Characteristic Curves for Different Geosynthetics The performance of six different geosynthetics at three different locations of layered pavement systems were tested through two groups of laboratory capillary rise tests. The three locations are in the base course, between the base course and the subgrade, and in the subgrade (Please see FIGS. 1 and 2). The D1 material with 10% of fines content and Fairbanks silt was used to represent the base course layer and the subgrade of the pavement structure, respectively. In the first group of tests (FIG. 1), all the geosynthetics were wrapped in the membrane, which is referred to as "no drainage" in the later discussion. In the second group of tests, only the top and bottom halves of the soil specimens were wrapped in the membrane while geosynthetics specimens had larger size (about 6 inches in diameter) and exposed partially in the air to increase the evaporation, which is referred to as "with drainage" in the later discussion (FIG. 2). Six different geosynthetics were tested and total 36 tests were performed for three different locations. For each location, it included one reference soil tests, six soil columns with geosynthetics inside but no drainage, and six soil columns with geosynthetics inside and with drainage. The purposes of the two groups of tests were (1) to investigate if the geosynthetics can cut off the capillary rise, and (2) to investigate the influence of evaporation on the water content distribution of the pavement structure. The first group of tests was used to simulate the geosynthetic in the center of the pavement structure, while the second group of tests is used to simulate the performance at the shoulder of the pavement structure. For each group of tests, there was also a reference soil column with no geosynthetic inside. The geosynthetic specimens used in the tests, where specimens 1 through 6 were Mirafi® FW402, Mirafi® G-Series Drainage Composites, Glass fabric, Mirafi® HP570, Mirafi Nylon Wicking Fabric, and Imp, respectively.

Specimens were compacted in three layers, 25 blows to each layer. A total of twenty six specimens were compacted. Each was 4.5 inches in height. After the specimens were made, a capillary barrier was placed on top of a specimen. Another specimen was placed on top of the capillary barrier. A plastic membrane was placed around each specimen for moisture control. The top of the silt specimens that were placed on top of the capillary barriers were sealed to eliminate evaporation. A total of 13 soil columns were made. The soil columns were then placed in a pan and water was periodically poured into the pan to maintain a height of about 0.5 inch to wet the soil from the bottom. After two weeks the specimens were taken out of their water baths in order to measure the moisture content at various heights. The specimens were taken apart and the capillary barrier was removed. A ruler was used to measure the appropriate width of each section. Each section was 1.5 inches in width. Both the top and bottom specimens were cut into three equal sections. A knife was used to cut each section. Once each section was removed, its weight was weighed on a scale the type of capillary barrier and its section height was recorded and the section was placed in a pan that would correspond to that particular specimen. This was done for each specimen. Afterwards, the pans were put in the oven and weighed again 24 hours later in order to obtain the dry weights.

FIGS. 5 through 17 show the laboratory silt/silt capillary rise test results. FIGS. 18 through 30 show laboratory D-1/D-1 capillary rise test results. FIGS. 31 through 43 show laboratory D1/silt capillary rise test results.

Example 6

Salt Concentration Test and Pressure Plate Test

The salt concentration tests were used to measure the soil water characteristic curve for suction values are greater than 1,500 kPa. Specimen 2 and 3 show reasonable curves as shown in FIGS. 44 and 45, but the curve for specimen 5 seems a little strange as shown in FIG. 46. For this reason, the results are currently being redone. The results may have been construed by a number of things. The first of which is the handling of the materials. Although gloves were used and precautions were taken to prevent moisture from escaping from the capillary barrier, this may have been a source of error. This may account for the extremely low moisture content levels that were found. Another reason may be that the salt concentration levels within the test containers are off. A reason for this may be because the duck tape that was used is not adhering to the glass container as well as one might expect. The results from the next test should prove helpful in determining where the error is coming from.

The pressure plate tests in accordance with ASTM D2325-68 were used to obtain the water retention characteristic curve in the range from 0 to 1500 kPa. Data is currently being collected for the pressure plate test. After the data is collected, the specimens need to be dried in order to determine their dry weight which is used to determine the moisture content. Once the moisture contents are determined, the specimens will be saturated and put back into the pressure plate apparatus at a different suction.

Example 7

Configuration of Pavement Section

Preliminary numerical simulations of performance of wicking fabric in expansive soils were performed by assuming material properties of the wicking fabric. FIG. 47 shows an example of a typical configuration of the pavement section studied, and the mechanical boundary conditions are also shown.

In the example, the concrete slab was 0.25 meter (10-in) thick. Those concretes were made with gravel aggregates from Victoria, Tex., 0.45 of water-cementitious ratio (w/cm). The concrete has a Young's Modulus of $E=2\times10_{7}$ kPa, Poisson's ratio v=0.15, and hydraulic conductivity of $K=1\times10_{-12}$ m/s. Due to the symmetry of the pavement structure, a 5-meter (16.4-ft) of width was chosen. The suction at a depth of 6.0 m was constant and assumed to be equal to 10 kPa, which is just above the ground water table.

The suction at the ground surface was assumed to be 1000 kPa for the first approximation. For the left and right sides of the structure, only vertical displacements were allowed due to symmetry.

Example 8

Simulation of Soil-Structure Interaction

Coupled thermal-mechanical jointed (contact) elements in ABAQUS/Standard (2002) are used to simulate the interaction at the soil-concrete slab interface. The upper side of the contact element is the bottom surface of the concrete slab and the lower side is the ground surface where the concrete slab is resting. The bottom face of the concrete slab is assigned to be the master surface and the ground surface is assigned to be the slave surface. Namely, the concrete can penetrate into the soil while the soil can not penetrate into the concrete (ABAQUS/Standard 2002).

The "hard" contact relationship in ABAQUS is used to simulate the normal behavior at the soil-slab interface. During the simulation, the program will compute the thickness of the contact elements in the direction normal to the soil-structure interface. When the soil and the slab foundation are in contact (the thickness of the contact element is zero), any compressive load can be transferred from the slab to the soil. When the soil and the foundation are not in contact (the thickness of the contact element is greater than zero), no load can be transferred from the slab to the soil.

The basic Coulomb friction model is used to simulate the tangential behavior in the soil structure interaction in which the two contacting surfaces can carry shear stresses up to a certain magnitude across their interfaces before they start sliding relative to one another.

It is also assumed that no water is allowed to flow through the soil-slab interface. This condition is realized by defining a very low "gap conductance" to the jointed elements. The gap conductance of the contact elements is assumed to be $10^{-30}$ $S^{-1}$ when the slab and the soil are in contact with each other. The gap conductance of the contact elements is assumed to be 0 when the slab and the soil are separated.

Example 9

Discussion of Simulation Results

The wicking fabric was installed at a depth of 1.0 m below the concrete slab. The wicking fabric was assumed to be under high compression with a bulk factor of 1. It had an ability to transport water at a rate of 1.48 gal/hour/yard. This corresponds to an ability of horizontal permeability of $2\times10^{-3}$ m/s (for a wick fabric with a thickness of 1 mm, transmissivity is $2\times10^{-6}$ $m^2/s$). Three different wicking fabrics were considered as follows:

1. The ability of the wicking fabric to transport water is limited so that the wicking fabric works as reinforcement only just like geo-textile. This case is referred to as "reinforcement only" in the following discussions;
2. The wicking fabric is highly permeable in all directions. This case is referred to as "single layer wicking fabric" in the following discussions; and
3. The wicking fabric is highly permeable in the direction towards outside of the pavement only and impermeable in the other two directions. This case is referred to as "wicking fabric with impermeable layer" in the following discussions. It was used to simulate the wicking drainage board proposed in the previous progress report.

Two different conditions were considered. One is that the concrete slab is integrated and there is no leakage form the slab to the subgrade, and the other is that there was a leakage at the center of the slab, which caused the suction in the range of 1.0 meter below the centerline were equal to 10 kPa (field capacity).

In order to investigate the influence of the wicking fabric on the performance of the pavement structure, conditions when there is no inclusion of wicking fabric were also considered. A total of eight simulations were performed as shown in Table 3.

TABLE 3

Summary of the numerical simulation

| | | Case | Max. Von Mises Stress (kPa) | Length of Unsupported Slab (m) |
|---|---|---|---|---|
| No Leakage | 1 | No Geosynthetic | 2399 | 1.1 |
| | 3 | Reinforcement Only | 2668 | 1.1 |
| | 5 | Single Layer Wicking Fabric | 517.6 | 0.162 |
| | 7 | Wicking Fabric with Impermeable Layer | 517.6 | 0.162 |
| With Leakage | 2 | No Geosynthetic | 3597 | 1.4 |
| | 4 | Reinforcement Only | 3600 | 1.4 |
| | 6 | Single Layer Wicking Fabric | 3527 | 1.26 |
| | 8 | Wicking Fabric with Impermeable Layer | 1425 | 0.079 |

The simulations were performed under steady state conditions. Two parameters were used to evaluate the performance of the pavement structure. The first one was the "length of unsupported slab", which is length of the slab which was not supported by the subgrade soils. This parameter is related to the differential settlements caused by the expansive soils under certain weather conditions.

The second parameter was the Von Mises stresses. A Von Mises stress is a stress-invariant used in yield criteria. It is calculated independently of the coordinate reference system, does not carry directional stress information such as normal and shear stresses, but carries enough information to identify hot-spots where failure might occur. The larger the Von Mises stresses, the higher possibility of damage there is.

In the simulation of a pavement structure built on expansive soils with no wicking fabric and no leakage, the expansive soils underneath the concrete pavements are covered by the concrete slab so that there is no evaporation of water while the soils outside the concrete slab are subjected to evaporation. As a result, the soils underneath the concrete slab have lower suction values, which correspond to higher moisture contents. While the soils outside of the slab have high suctions and lower water contents (drying). The difference in moisture contents due to the coverage of the concrete slab can cause large differential settlements. The soils at the shoulder of the concrete pavements shrink more than the soils underneath the slab, which cause a phenomenon called "shoulder rotation" or "edge-drop" case. The differential settlement can be so large that part of the concrete slab loses support from the subgrade soils and make the concrete slab a cantilever. This will cause very large bending moments in the concrete slab, which can result in damage to the slab. The maximum Von Mises Stress for this case is 2399 kPa, which is occurring in the center of the slab. The slab and the soils separated at the edge of the slab and the length of the separation is 1.1 m for a 5.0 m concrete slab as shown in Table 3.

Case 2: No Wicking Fabric, With Leakage

In the simulation of pavement structure built on expansive soils with leakage and no wicking fabric, there is a leakage underneath the center of the slab, which makes the soil wetter than the previous case. Outside of the slab, the soils were still dry due to evaporation. As a result, the differential movements are larger than the previous case. The length of unsupported slab is about 1.4 m and the maximum Von Mises stress is 3597 kPa, about 50% higher than the previous case. In conclusion, leakage in the pavement structure will make the differential settlements much severe and more likely to result in damage to the pavement structure. Cases 1 and 2 were used as references to demonstrate the influence of wicking fabric on performance of the pavement structure.

Case 3: With Geotextile Reinforcement, No Leakage

In this case, a geotextile was included in the pavement structure at a depth of 1.0 m below the concrete pavement. The geotextile was assumed to have the same permeability as that for the soils because it is relatively thin. Its Young's modulus was assumed to be 200,000 kPa, which is much stronger than the expansive soils. In the simulation of pavement structure built on expansive soils with geotextile reinforcement and no leakage, the inclusion of the geotextile reinforcement had no influence on suction distribution. Although the length of the unsupported slab was 1.1 m (the same as that for case 1), the maximum Von Mises Stress was 2668 kPa, 11% higher than that when there is no reinforcement. This case indicates the inclusion of a reinforcement does not cause any benefit for the pavement structure for the differential settlement caused by expansive soils.

Case 4: With Geotextile Reinforcement, With Leakage

In this case, there is a leakage underneath the center of the concrete slab. As a result, the suction was 10 kPa in the range of 1.0 m below the concrete slab. Just like case 2, the leakage significantly increases the differential settlements in the subgrade soils. As a result, the length of unsupported slab is 1.4 m and the maximum Von Mises stress is 3600 kPa, which are basically the same as those in case 2. Again, this case indicates that inclusion of a geotextile reinforcement will not reduce the differential settlements caused by expansive soils.

Case 5: With a Single Layer of Wicking Fabric, No Leakage

This case is used to simulate the case when the wicking fabric is installed in a pavement structure. In the simulation of pavement structure built on expansive soils with a single layer of wicking fabric and no leakage, due to the high ability of the wicking fabric to transport water, the wicking fabric significantly increase the suction under the concrete slab and suction distributions in the pavement structure is more uniformly distributed with depth. As a result, the differential settlement in the pavement structure is very small.

The length of unsupported slab is only 0.162 m, which is mainly limited at a very small range close to the edge of the slab. Due to the fact that most of the slab is rest on the subgrade soils and suction difference underneath the slab is small, the stress in the slab is small (if the differential settlements are zero, the stress in the slab will be the smallest).

The maximum Von Mises stress is only 517.5 kPa, less than 22% of the maximum Von Mises stress for case 1 when there is no wick fabric. This case indicates that inclusion of the wicking fabric can significantly improve the pavement performance and the pavement is much less likely to damage compared with case 1.

Case 6: With a Single Layer of Wicking Fabric, with Leakage

The difference between cases 6 and 5 is that there is a leakage underneath the centerline of the concrete slab. Due to the leakage, the soil underneath the centerline of the slab is very wet with a suction of 10 kPa, while the outside still remains 1000 kPa. The difference in suction is large. As a result, the differential settlements are very big. The leakage not only causes swelling for soil above the wicking fabric, it also causes swelling of the soil beneath the wicking fabric. The final length of unsupported slab is 1.26 m, and the maximum Von Mises stress is 3527 kPa. Compared with cases 2 and 4, inclusion of the wicking fabric only slightly improves the performance of the pavement structure when there is leakage. It is worth noting that case 6 is a steady state simulation in which the leakage is assumed to be lasting for a significant period of time. Under a real situation, a rainfall event only lasts for a short period of time. Therefore, the actual improvement made by including a wicking fabric might be greater than the simulation. This case was performed for comparison purposes only.

Case 7: Wicking Fabric with Impermeable Layer, No Leakage

This case simulates the situation in which the wicking drainage board discussed above is installed in a pavement structure. In this simulation of a pavement structure built on expansive soils with the installation of the wicking drainage board and no leakage, the wicking drainage board significantly increases the suction under the concrete slab and suction distributions in the pavement structure is more uniformly distributed with depth as in case 5. The differential settlement in the pavement structure is very small. The length of unsupported slab is only 0.162 m and the maximum Von Mises stress is only 517.5 kPa. The results obtained are like those obtained in case 5. This case indicates that inclusion of wicking drainage board can significantly improve the pavement performance.

Different from case 7, in case 8 there is a leakage underneath the centerline of the slab. The leakage causes suction increase underneath the slab, resulting significant difference between the centerline and outside of the slab. However, due to the wicking drainage board is impermeable in the vertical direction, the wetting of the soil is limited between the concrete slab and the wicking drainage board. Also, because the drainage board is permeable on both sides, the bottom side can still drain water out of the pavement structure even when there is leakage on the top. As a result, the soil at the centerline is still drying below the wicking drainage board.

The wetting of the soil above the wicking drainage board causes the soil to swell, while the drying of the soil below the wicking drainage board causes the soil to shrink. These two effects counterbalance and reduce the differential settlement even when there is leakage at the center of the slab. In case 8, the slab and the soils are in good contact with a length of unsupported slab of 0.079 m. Consequently, the maximum Von Mises stress is 1425 kPa, about 60% and 40% of the maximum Von Mises stresses in cases 1 and 6, respectively. The maximum Von Mises stresses and length of unsupported slab in cases 7 and 8 are much smaller than those under similar situations. It is concluded that inclusion of wicking drainage board can significantly improve the performance of pavement structure.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A woven geotextile wicking fabric comprising:

a polymeric yarn disposed in one axis of the fabric, and a plurality of wicking fibers disposed substantially parallel to one another and woven with the polymeric yarn in another axis of the fabric, the wicking fiber comprising a non-round or non-oval cross-section and having a surface factor of about 100 cc/g/hr to about 250cc/g/hr.

2. The wicking fabric of claim 1, wherein the cross-sectional shape of the wicking fiber is multichannel, trilobal, or pillow.

3. The wicking fabric of claim 1, wherein the wicking fiber comprises nylon.

4. The wicking fabric of claim 1, wherein the wicking fiber has a surface area of 3650 $cm^2/g$.

5. The wicking fabric of claim 1, wherein the wicking fiber has a permeability of 0.55 cm/s.

* * * * *

UNITED STATES PATENT AND TRADEMARK OFFICE

CERTIFICATE OF CORRECTION

PATENT NO. : 7,874,767 B2
APPLICATION NO. : 12/359876
DATED : January 25, 2011
INVENTOR(S) : Jones et al.

It is certified that error appears in the above-identified patent and that said Letters Patent is hereby corrected as shown below:

In the Specification:
In column 2, line 20, delete “surface factor” and insert --flux--.
In column 3, line 66, delete “less” and insert --greater--.
In column 6, line 57, delete “$cc^2g$” and insert --$cm^2/g$--.

In the Claims:
In column 16, lines 19-20, Claim 1, delete “surface factor” and insert --flux--.

Signed and Sealed this
Twelfth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 7,874,767 B2
APPLICATION NO. : 12/359876
DATED : January 25, 2011
INVENTOR(S) : David M. Jones et al.

It is certified that error appears in the above-identified patent and that said Letters Patent is hereby corrected as shown below:

In the Specification,

In column 10, lines 34-37, delete "FIGS. 5 through 17 show the laboratory silt/silt capillary rise test results. FIGS. 18 through 30 show laboratory D-1/D-1 capillary rise test results. FIGS. 31 through 43 show laboratory D1/silt capillary rise test results.".
In column 10, line 45, delete "curve" and insert --curves--.
In column 10, line 45, delete "are.".
In column 10, line 46, delete "Specimen" and insert --Specimens--.
In column 10, lines 46-47, delete "as shown in FIGS. 44 and 45.".
In column 10, line 48, delete "as shown in FIG. 46.".
In column 10, line 57, delete "duck" and insert --duct--.
In column 11, lines 11-14, delete "FIG.47 shows an example of a typical configuration of the pavement section studied, and the mechanical boundary conditions are also shown.".

Signed and Sealed this
Twenty-third Day of June, 2015

Michelle K. Lee

Michelle K. Lee
*Director of the United States Patent and Trademark Office*